US005718218A

United States Patent [19]

Pagani et al.

[11] Patent Number: 5,718,218

[45] Date of Patent: Feb. 17, 1998

[54] REGENERATOR WITH TUBE SYSTEM, PARTICULARLY ADAPTED FOR FIREPLACES AND THE LIKE

[76] Inventors: Attilio Pagani; Livia Serafini Pagani, both of Via Verde, 15-20067, Zoate (Prov. di Milano), Italy

[21] Appl. No.: 740,281

[22] Filed: Oct. 25, 1996

[30] Foreign Application Priority Data

Oct. 30, 1995 [IT] Italy ..... MI95U0748

[51] Int. Cl.[6] ..... F24B 1/88

[52] U.S. Cl. ..... 126/526; 126/524

[58] Field of Search ..... 126/524, 526, 126/540

[56] References Cited

U.S. PATENT DOCUMENTS 4,091,794 5/1978 Stites ..... 126/524
4,332,136 6/1982 Stora et al. ..... 126/524

FOREIGN PATENT DOCUMENTS 0 131 550 1/1985 European Pat. Off. .
2 456 907 12/1980 France .
2 494 060 4/1982 France .

*Primary Examiner*—Carroll B. Dority
*Attorney, Agent, or Firm*—Guido Modiano; Albert Josif

[57] ABSTRACT

Regenerator with tube system, particularly for fireplaces and the like, which can be inserted at the firebox of fireplaces and comprises a metallic heat-exchange body that is constituted by a single tubular body shaped so as to have straight and parallel portions that rest on the heart of the firebox, two identical curved loop portions that rest on the rear vertical wall of the firebox, a single transverse loop lying at the front of the firebox, and two ends that are parallel and close to each other, and are directed towards the outside of the fireplace, one of the ends being connected to a box-like body that contains a motorized fan for sending the ambient air to be heated into the heat-exchange body, the other end being connected to a duct for delivering the heated air into the surrounding space, the delivery duct being also contained in the box-like body.

7 Claims, 3 Drawing Sheets

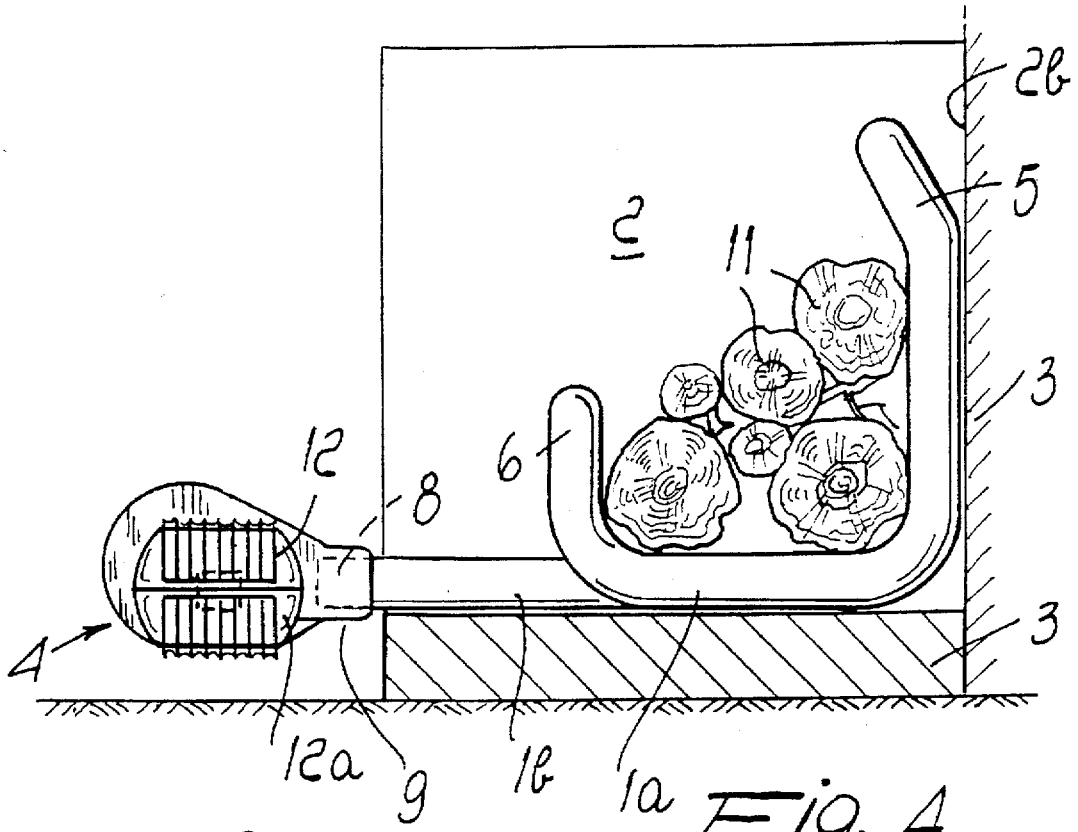
Fig. 3
Fig. 4
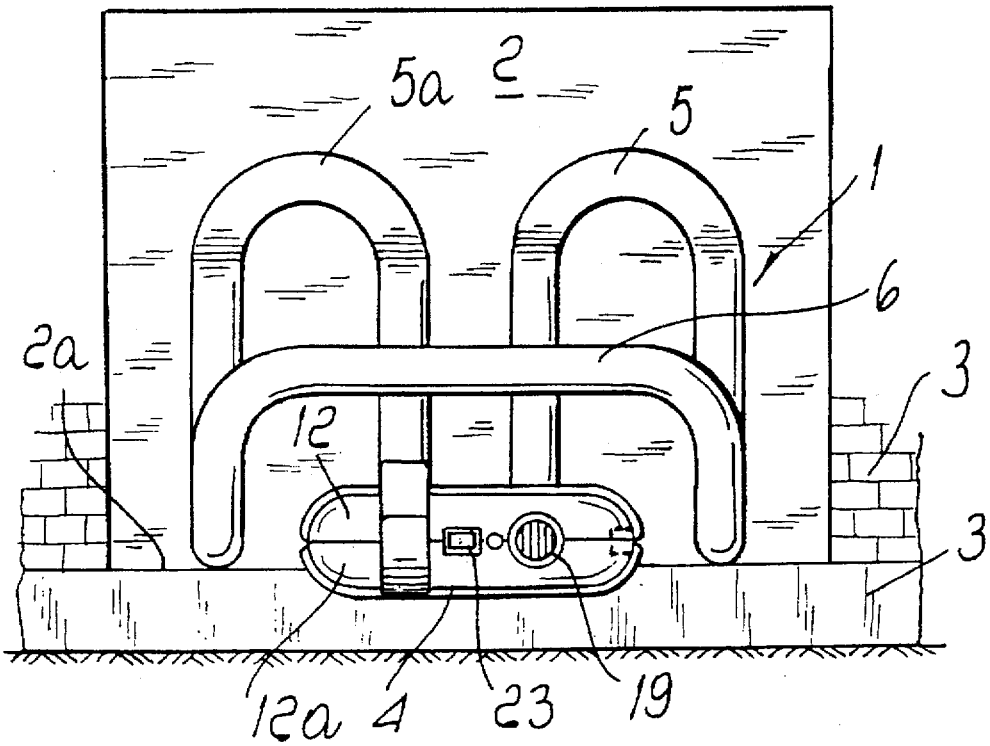

4
12,12a
25
20
13
19
26
9
14
1b
7
14a
22
24
23
18
17
1c
10
15
8
15a
16
13
20
21

REGENERATOR WITH TUBE SYSTEM, PARTICULARLY ADAPTED FOR FIREPLACES AND THE LIKE

BACKGROUND OF THE INVENTION

The present invention relates to a tube bundle regenerator (with tube system), adapted for fireplaces and the like fired by wood and coal fuels (in chips, briquettes, and pellets obtained from pressed powder).

It is well-known that fireplaces fired by solid fuel as wood and the like allow to provide a form of heating that is economically not very advantageous from the point of view of thermal efficiency although it can be rather pleasant.

Various solutions have already been proposed in order to try to improve the efficiency of these fireplaces; in particular, various types of regenerators, arranged within the firebox, have been proposed with the purpose of at least partially recovering the calories that otherwise would be lost through the flue.

Current regenerators for these wood-fired fireplaces use tube bundle or box-type plate means that are arranged in various manners in the firebox, are connected at one end thereof to a motorized fan, and are directed towards the room with the other end, so as to send air that has been heated inside said tube bundle into the surrounding area.

In practice it has been observed that current regenerators are structurally very complicated and normally anchored to the firebox, besides being very bulky and often aesthetically unpleasant; accordingly, so far they have been used in practice only to an extremely limited extent.

SUMMARY OF THE INVENTION

A principal aim of the present invention is to provide a regenerator for fireplaces and the like that is conceived so as to drastically reduce the drawbacks and limitations of currently commercially available regenerators and is most of all such that it can be easily inserted in the firebox region and neither alter combustion nor reduce the useful area of said firebox to any significant extent.

An object of the invention is to provide a regenerator that is structurally simple and compact, highly reliable, and has a highly competitive economical cost.

Another object of the invention is to provide a regenerator for fireplaces that also allows to contain the wood being burned without reducing the stream of comburent air and without requiring the conventional andirons to support the wood pieces.

Moreover, it allows to easily use andirons to be placed to the side of the single-tube structure, whilst said structure has been designed to contain a correct amount of wood so as to avoid any waste.

Another object is to provide a regenerator that is structured so that it can be easily disassembled into its main components, so as to allow to easily remove it from the firebox area to clean it, maintain it, or store it when it is not being used.

This aim, these objects, and others that will become apparent from the following description are achieved by a regenerator, particularly adapted for fireplaces fired by solid fuel, which can be inserted in the firebox of the fireplace and comprises, according to the present invention, a metallic heat exchange body that is constituted by a single tubular body formed by using special equipment specifically designed for this purpose, said tubular body being shaped so as to have straight and parallel portions that rest on the hearth of the firebox, two identical curved loop portions that rest on the rear vertical wall of the firebox, a single transverse loop that lies at the front of said firebox, and two ends that are parallel and close to each other, and are directed towards the inside of the fireplace, one of said ends being connected to a box-like body that contains a motorized fan for sending the ambient air to be heated into the body, the other end being connected to a duct for delivering the heated air into the surrounding space, said delivery duct being also contained in said box-like body.

More particularly, said two loops that rest on the rear vertical wall of the firebox and said single loop arranged at the front form, as a whole, a substantially cradle-like structure that can retain the wood fuel being burned without reducing the space required for the passage of the comburent air required by combustion.

BRIEF DESCRIPTION OF THE DRAWINGS

Further characteristics and advantages of the invention will become apparent from the following detailed description, given with reference to the accompanying drawings, which are provided only by way of non-limitative example and wherein:

FIG. 3 is a front view of the regenerator shown in FIG. 1;

FIG. 4 is instead a side view of the regenerator shown in the preceding figures, illustrating the load of wood retained between opposite loops of the tubular body.

DESCRIPTION OF THE PREFERRED EMBODIMENTS

Figure 1:
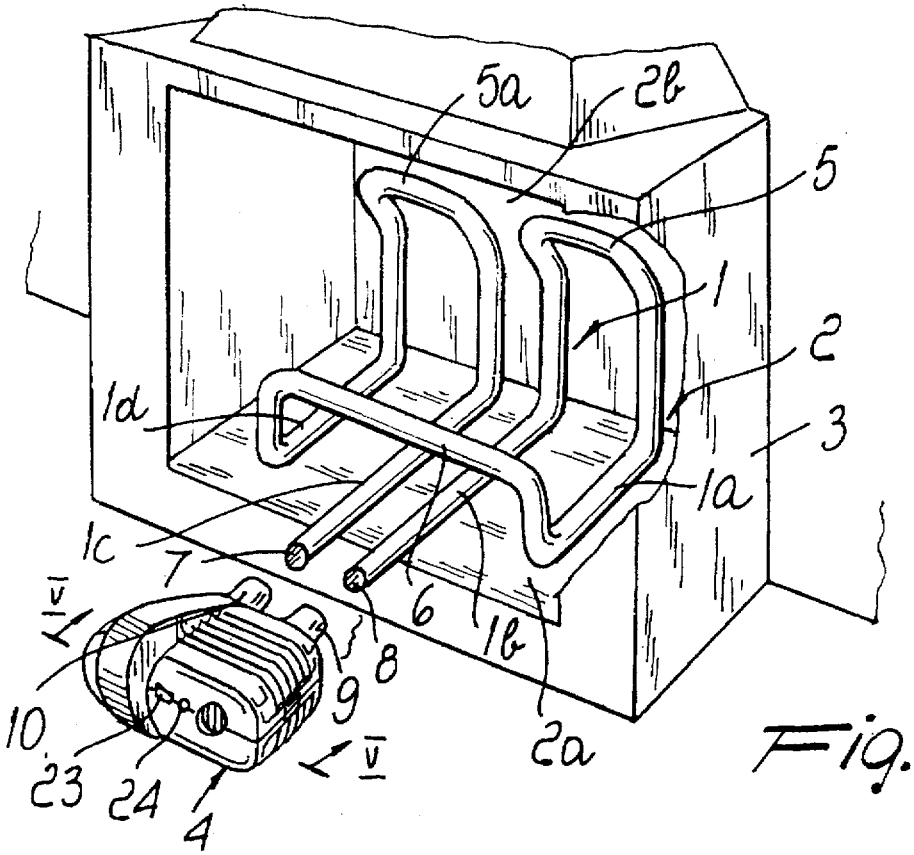
FIG. 1 is a perspective view of the regenerator executed according to the invention, shown in its stable position inside a conventional wood-fired fireplace and separately from the block containing the motorized fan.
Figure 2:
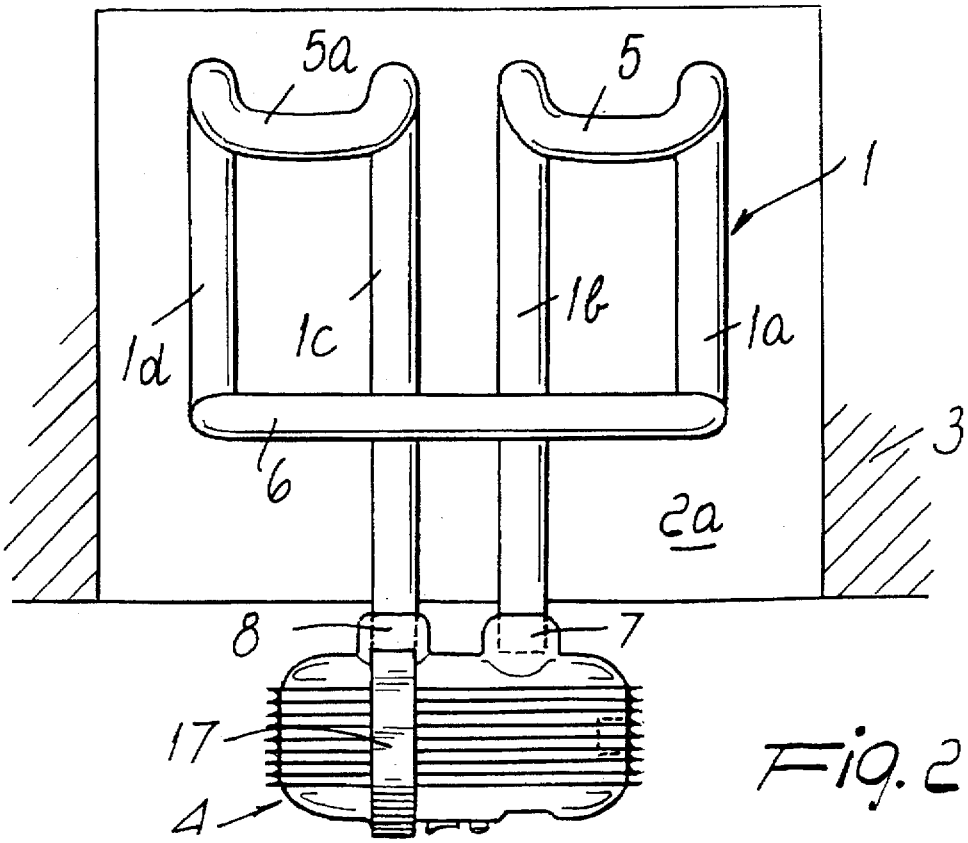
FIG. 2 is a top view of the regenerator of FIG. 1, with the tube body connected to the motorized fan block.

With reference to the above figures, the regenerator according to the present invention is substantially constituted by a metallic heat-exchange body, generally designated by the reference numeral 1 in the figures, which can be accommodated in the firebox 2 of a conventional fireplace 3, and by a container or block 4 that contains a motorized fan, can be detachably associated with said heat-exchange body 1, and protrudes outside the fireplace.

More particularly, said metallic heat-exchange body 1 is substantially constituted by a single tubular body that has a constant cross-section and is shaped so as to assume a configuration that can be likened to a wide stylized letter U or to a cradle, and is more specifically shaped so as to have straight portions 1*a*-1*b*-1*c*-1*d* that are parallel to each other and are arranged so as to rest on the hearth 2*a* of the firebox and are mutually connected in pairs so as to allow the portions 1*a*, 1*b* to form a wide loop 5 and allow the portions 1*c*, 1*d* to form a similar loop 5*a*, both loops being arranged at 90° with respect to the portions that rest on the hearth 2*a*; said loops 5–5*a* are arranged in contact with the rear vertical wall 2*b* of the firebox, in a symmetrical position with respect to the median axis of the hearth 2*a*; the outermost portions 1*a*–1*d* are instead connected so as to form a single wide loop 6 that is arranged parallel to the rear loops and is not as high as said rear ones.

Furthermore, the innermost horizontal portions 1*b*–1*c* are close to each other, so that their ends 7–8 which constitute the inlet and the outlet of the single tubular body 1 are in a position that allows them to be connected to the block 4 by means of cylindrical unions 9 and 10 that are rigidly coupled to said block 4.

An adjustment device of the screw type or the like (not shown) is provided in the rear part of the horizontal portions of the tube system to allow the horizontal alignment of the horizontal portions of the tube system with respect to the hearth 2*a* of the firebox, which is usually inclined towards the inside of the fireplace.

The entire block of the tube system can also be easily removed from the block 4, which lies outside the fireplace, to clean said fireplace and to allow transport and storage when not in use. Likewise, the particular configuration of the tube system allows to contain solid fuel, i.e. the wood fuel 11 or coal in pellets or briquettes etcetera (FIG. 4) between the rear loops 5–5*a* and the front loop 6.

Figure 5:
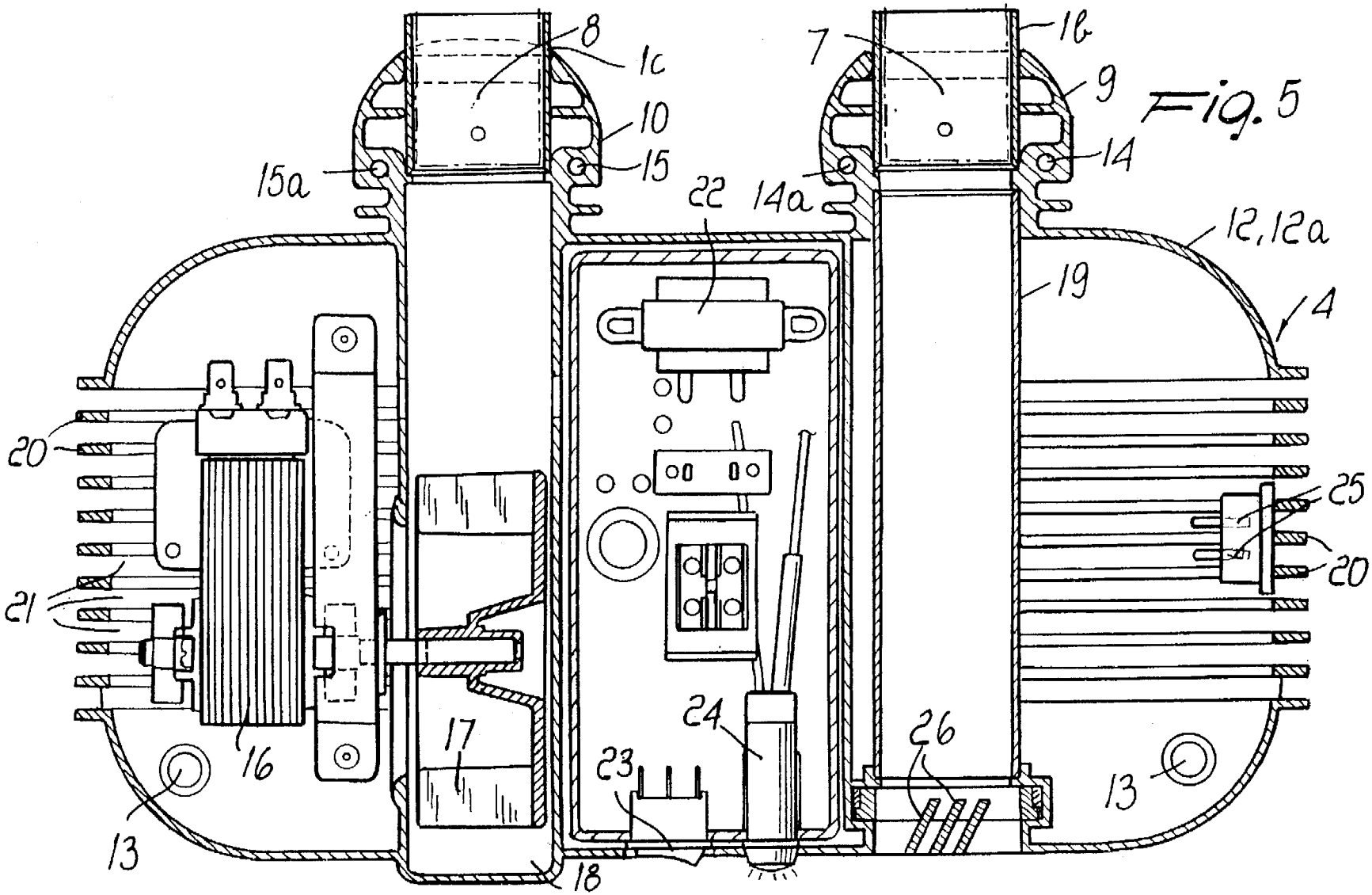
FIG. 5 is an enlarged-scale median horizontal sectional view of the block containing the motorized fan, taken along the plane V—V of FIG. 1.

Said block 4 is substantially constituted by an ovoid container with two metal shells 12–12*a* that can be assembled by means of screws inserted in the holes 13 (FIG. 5) and in the pairs of holes 14–14*a* and 15–15*a* that are provided in the cylindrical unions 9 and 10 that lock the two ends of the tube system.

An electric motor 16 is arranged on one side inside said ovoid container and drives an impeller 17 contained within a scroll 18 that is in turn connected to the end of the intake duct 8 of the horizontal tube portion 1*c*, so as to send air drawn from the room into the tube system in order to heat it while the wood burns; on the other side of said container there is provided a tube portion 19 which is parallel to the scroll 18 and can be connected axially to the portion 7 of the tube for delivering the heated air into the surrounding space.

On a band of the container that is orientated at right angles to the ducts for feeding cool air and for discharging the heated air protruding parallel fins are provided, generally designated by the reference numeral 20, which have, at the motor 16, openings 21 that are respectively meant to allow to cool the motor by aspiration on the part of the impeller 17 and the heated air delivery duct 19.

Accordingly, the impeller 17 draws in the air through the finned openings and makes it flow out onto the active parts of the motor, performing the necessary cooling of said motor before sending the air into the heat-exchange circuit.

Said container 4 also contains an impedance component 22 (substantially a transformer) through which a reduced operating speed of the motorized fan is achieved.

Seats are furthermore formed, in the region that faces the room, for applying and operating a switch 23 for supplying electric power to the motor and for accommodating a luminous indicator 24 that indicates that the unit is operating even whilst the fuel is crackling.

An appropriate recess is formed between the fins, on the side lying opposite to the ambient air intake, in order to place a male connector 25 that is adapted to couple to the corresponding female connector that is in turn connected to the power cord. It is thus possible to remove and store said cord conveniently when the device is not being used.

A rotary flow deflector 26 is applied at the end part 19 of the delivery duct 1*b* and has movable fins that allow to direct the stream of warm air into the room as desired.

The two cylindrical unions 9 and 10 protrude from the block 4 to accommodate the tubular end parts 7 and 8 of the heat exchanger. Finally, adapted screws inserted in the holes 14–14*a* and 15–15*a* allow to stably and safely ensure this coupling, but at the same time allow to provide, if necessary, simple and practical disassembly of the two components 7 and 8.

Of course, the scope of the protection of the invention as described and illustrated includes all possible modifications and variations that allow to achieve the same utility and effectiveness as the present invention.

What is claimed is:

1. In a fireplace for solid fuels, having a firebox defining an inside region thereof, the firebox including a hearth, a rear vertical wall and a front part, a regenerator comprising:

a metallic heat-exchange body constituted by a single tubular length, said tubular length being shaped for having straight and parallel portions resting on said hearth, two identical curved loop portions resting on said rear vertical wall, a single transverse loop lying at said front part of the firebox, and two ends being parallel and close to each other, said ends being directed away from said inside region of the firebox;

a box-like body connected to said ends of said heat-exchange body;

a motorized fan for sending ambient air to be heated in said heat-exchange body, said fan being contained in said box-like body and connected to a first one of said ends;

a delivery duct being contained in said box-like body and connected to a second one of said ends for delivering heated air.

2. Regenerator according to claim 1, wherein said loop-shaped portions are arranged vertically with respect to the hearth of the firebox and said front loop forms a substantially cradle-shaped structure, having a substantially U-shaped form and structure retaining the solid fuel.

3. Regenerator according to claim 1, wherein said box-like body that contains said motorized fan and said delivery duct is constituted by two substantially ovoid half-shells, said half-shells being coupleable to each other through screws so as to form a block, said block being supported in a cantilevered fashion by said ends of the tubular heat-exchange body that protrude from the hearth of the firebox.

4. Regenerator according to claim 3, wherein said box-like body that contains the motorized fan is provided, on at least part of its outer surface, with protruding fins and with openings between said fins, said openings allowing to cool a motor of said motorized fan and the heated air delivery duct cooling being carried out by air aspirated by an impeller of said fan through said openings.

5. Regenerator according to claim 4, wherein an impedance element, substantially a voltage transformer, is inserted in said box-like body, said transformer being actuatable for achieving a preset reduction in a rotation rate of said motorized fan, a power switch and a luminous indicator being further provided on a front part of said box-like body, and a male connector being formed, between said fins, on a side opposite with respect to a side related to the openings for air aspiration, said connector being coupleable to a female socket, said female socket being a power mains.

6. Regenerator according to claim 4, wherein a manually-controlled rotary flow deflector with steerable fins is applied to an end of the heated air delivery duct.

7. Regenerator according to claim 3, wherein said ends of the tubular heat-exchange body are detachably connected to the box-like containment body through cylindrical unions.

* * * * *